US006145768A

United States Patent [19]

Okuya

[11] Patent Number: 6,145,768

[45] Date of Patent: Nov. 14, 2000

[54] LAYOUT OF AN APPARATUS FOR CRUSHING-BREAKING USELESS CASTING PRODUCTS, A FIXED CUTTER DEVICE AND A ROCKING CUTTER DEVICE USED FOR THE APPARATUS, AND A METHOD FOR COATING THE FIXED CUTTER DEVICE AND THE ROCKING CUTTER DEVICE

[76] Inventor: Yasuaki Okuya, 52, Soramachi, Heisaka-cho, Nishio City, Aichi-Pref., 444-0305, Japan

[21] Appl. No.: 09/196,101

[22] Filed: Nov. 27, 1998

[30] Foreign Application Priority Data

Nov. 28, 1997 [JP] Japan ..... 9-329045
Jul. 27, 1998 [JP] Japan ..... 10-211583

[51] Int. Cl.[7] ..... B02C 1/10

[52] U.S. Cl. ..... 241/265; 241/291; 241/300

[58] Field of Search ..... 241/264–269, 241/300, 291

[56] References Cited

FOREIGN PATENT DOCUMENTS 27-9879 11/1927 Japan .
55-16801 2/1980 Japan .
6-106083 4/1994 Japan .
6-182238 7/1994 Japan .

*Primary Examiner*—Mark Rosenbaum
*Attorney, Agent, or Firm*—Pillsbury Madison & Sutro LLP

[57] ABSTRACT

It is an object of the present invention to provide a layout of a crushing-breaking apparatus capable of achieving a full-automated factory, improving the efficiency in operation and ensuring the safety. The layer comprises a crushing-breaking apparatus for crushing and breaking sprues, weirs, runners of casting products and useless casting products, the apparatus being arranged at a predetermined position in the factory, a feeding device sequentially supplying the sprues, weirs, runners of casting products and the useless casting products to the apparatus, and a discharging device sequentially conveying recyclable casting products crushed and broken by the apparatus. The layout is characterized in that the feeding device, the apparatus, and the discharging device are arranged adjacent to one another so as to carry out a series of procedures.

5 Claims, 19 Drawing Sheets

LAYOUT OF AN APPARATUS FOR CRUSHING-BREAKING USELESS CASTING PRODUCTS, A FIXED CUTTER DEVICE AND A ROCKING CUTTER DEVICE USED FOR THE APPARATUS, AND A METHOD FOR COATING THE FIXED CUTTER DEVICE AND THE ROCKING CUTTER DEVICE

CROSS-REFERENCE TO RELATED APPLICATION

The entire disclosure of both Japanese Patent Application No. Hei 9-329045 filed on Nov. 28, 1997 and Hei 10-211583 filed on Jul. 27, 1998 including specification, claims, drawings, and summary is incorporated herein by reference in its entirety.

BACKGROUND OF INVENTION

1. Field of the Invention

The present invention relates to a layout of an apparatus for crushing-breaking useless casting products such as sprues, runners and weirs. The present invention also relates to a fixed cutter device and a rocking cutter device used for the crushing-breaking apparatus, and a method for coating the fixed cutter device and the rocking cutter device.

2. Description of the Prior Art

The applicant has several patent applications related with the present invention, two of those are briefly described herein. One is entitled "A Hydraulic Crushing-Breaking Apparatus for Useless Casting Products of Runners and Weirs" filed on Sep. 28, 1992 (Japanese patent laid open publication No. Hei 6-106083, hereinafter referred to as reference A), and the other is entitled "A Crushing-Breaking Method for Uneven Useless Casting Products of Runners and Weirs" filed on Dec. 17, 1992 (Japanese patent laid open publication No. Hei 6-182238, hereinafter referred to as reference B).

The reference A discloses an apparatus which breaks and crushes useless casting products by engaging a fixed cutter device with a rocking cutter device, disposed opposite to each other. Also, the reference B teaches a method for crushing-breaking the useless casting products into a size suitable for an electric furnace, the features of which are similar to the reference A.

Further, other two applications entitled "Jaw Crusher Teeth" (Japanese utility patent laid open publication No. Sho 55-16801, hereinafter referred to as reference C) and "Teeth for a Breaking Crusher" (Japanese utility patent publication after examination No. Sho 27-9879, hereinafter referred to as reference D) were filed.

In the jaw crusher of the reference C, a plurality of pyramid-shaped projections are disposed on both a fixed jaw and a movable jaw, and the feature of the invention is to use the projections for crushing. Also, in the breaking crusher of the reference D, the crusher comprises a fixed teeth and a movable teeth both having projections formed longitudinally, and the feature of the invention is to use the projections for crushing.

Both the jaw crusher of the reference A and the method of the reference B are capable of crushing and breaking the useless casting products smoothly and reliably as a result of generating a large crushing-breaking force by utilizing a hydraulic cylinder. Both the crushers are also capable of controlling movement of the rocking cutter device in both forward and backward directions easily. Both the inventions having the advantages described above accomplish various remarkable results at factories, so that the crushers in accordance with the inventions are evaluated as very useful crushers. Further, the inventions disclosed in both the references C and D improve the crushing-breaking efficiency of the useless casting products because of their features.

However, none of the references A through the reference C teach nor disclose practical layout of the apparatus in the factory as well as a relationship with other equipment. Therefore, some improvements on a full-automated factory, operating efficiency and healthcare of the workers may be accomplished.

Also, no overlaying formed on the cutter devices including jaws and teeth such as the fixed cutter device and the rocking cutter device is taught and/or disclosed in the references A through the reference C. Therefore, some improvements on abrasion resistant property and/or impact resistant property of the cutter devices can be made.

SUMMARY OF THE INVENTION

It is an object of the present invention to provide a layout of a crushing-breaking apparatus capable of achieving a full-automated factory, improving operating efficiency while ensuring the safety of the workers in the factory.

In accordance with the present invention, there is provided a system including an apparatus for crushing and breaking sprues, weirs, runners of casting products and useless casting products comprising:

a feeding device sequentially supplying the weirs, runners of casting products and the useless casting products to the apparatus, the feeding device being arranged at a predetermined position in a factory, the crushing-breaking apparatus for crushing and breaking the casting products and the useless casting products supplied by the feeding device, the apparatus being arranged adjacent to the feeding device and at a predetermined position in the factory, and a discharging device sequentially conveying recyclable casting products crushed and broken by the apparatus, the discharging device being arranged at a predetermined position in the factory.

Also, in accordance with the present invention, there is provided a method for coating a fixed cutter device and a rocking cutter device composing an apparatus for crushing and breaking sprues, weirs, runners of casting products and useless casting products, the apparatus being arranged in a factory, the fixed cutter device having a plurality of projection shaped mating cutters in zig-zag fashion on a flat plane thereof, and the rocking cutter device having a plurality of projection shaped rocking cutters in zig-zag fashion on a flat plane thereof, the coating method comprising:

coating the flat plane of the fixed cutter device and that of the rocking cutter device, and circumferential surfaces of the mating cutters and that of the rocking cutters with at least a three-layered overlaying, and coating top surfaces of the mating cutters and that of the rocking cutters with at least a four-layered overlaying, wherein the circumferential surfaces of the mating cutters and that of the rocking cutters are coated by carrying out welding in a direction of the bottom of the mating cutters the rocking cutters.

While the novel features of the invention are set forth in a general fashion, both as to organization and content, the invention will be better understood and appreciated, along with other objects and features thereof, from the following detailed description taken in conjunction with the drawings.

DESCRIPTION OF THE PRESENT INVENTION

Layouts (systems) of a crushing-breaking apparatus in accordance with the present invention will be described hereunder referring to drawings.

Figure 7:
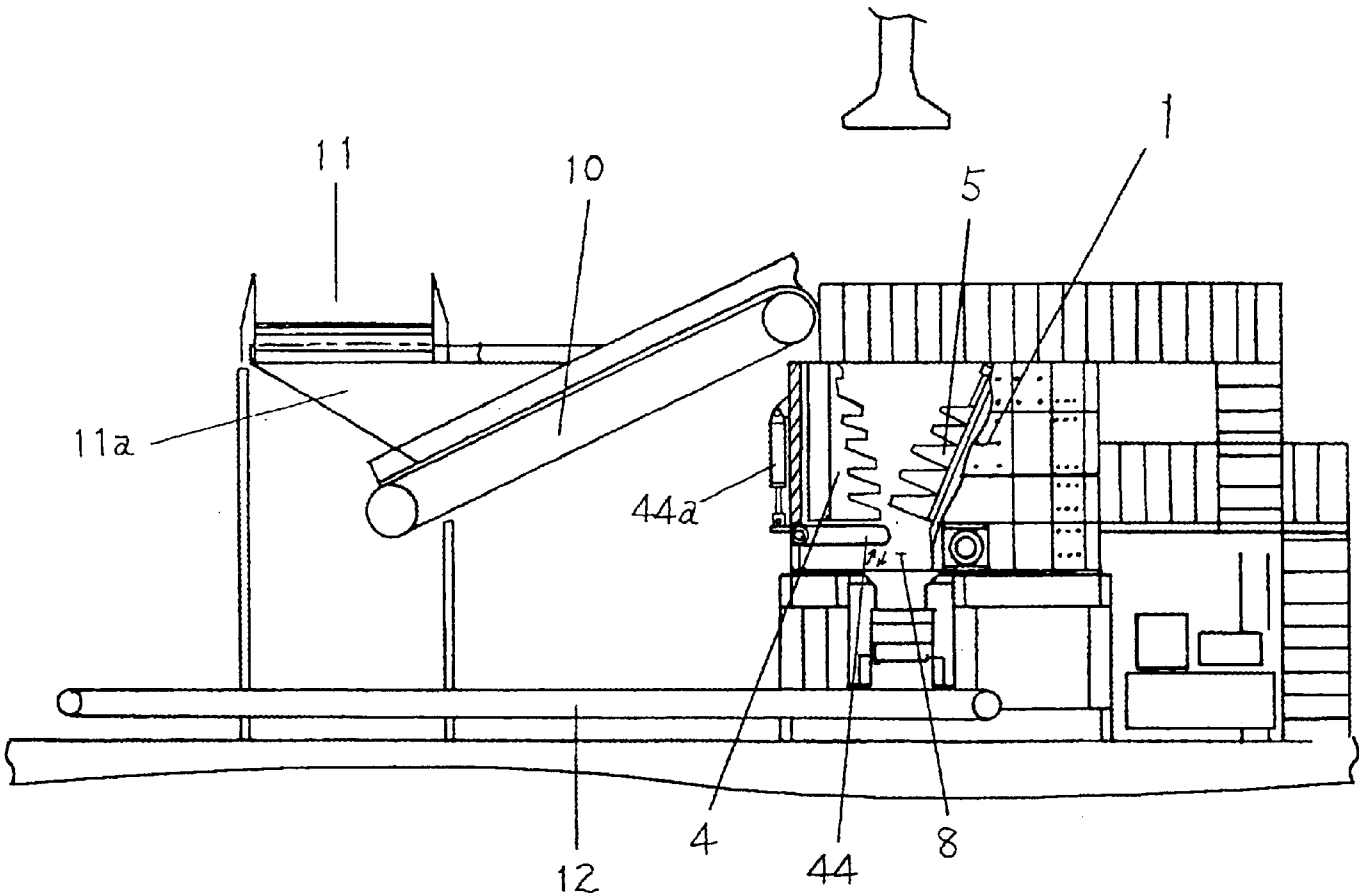
FIG. 7 is a typical side view showing the apparatus using a feeding conveyer.

FIG. 7 is an example of the crushing-breaking apparatus using a feeding conveyer for supplying useless casting products to the apparatus. The useless casting products are removed from a finished casting product by using a hammer, a cutter for weirs and a remover and the like.

The useless casting products thus removed are conveyed to the apparatus with an apron conveyer located adjacent to the remover and the like. A guide plate (not shown) and the feeding conveyer are located at the midway of a path for conveying the casting products in order to smoothly convey the products in "sand-free" manner within a limited space of the factory.

The casting products thus conveyed in "sand-free" manner are sequentially supplied to a V-shaped opening (hereinafter referred to as opening) defined by the fixed cutter and the rocking cutter device positioned at the back-most position. Thereafter, the useless casting products thus supplied are sequentially crushed and broken by engagement between the fixed cutter device and the rocking cutlery device moved to its foremost position through an extension of a piston rod of a cylinder.

The rocking device located at its foremost position is moved backwardly through a contraction of the piston rod of the cylinder when the casting products are crushed and broken in a predetermined size. The crushed-broken casting products in "sand-free" manner (recyclable casting materials) are discharged from the apparatus through a discharge outlet formed between a lower end of the rocking cutter device and that of the fixed cutter device by the backward movement of the rocking cutter device.

The crushed-broken casting products thus discharged are supplied to a furnace by using a conveyer for discharging (hereinafter referred to as discharging conveyer) and another conveyer. Forward or backward movement of the rocking cutter device is automatically controlled when too much pressure is provided to the apparatus (to the rocking cutter device), or when both forward and backward movement are repeatedly carried out (in a predetermined times) at the same position. Because the apparatus used in the layout employs automatic control by automatically stopping the piston rod of the cylinder in response to a signal from pressure sensors and automatically restarting the piston after the automatic stop.

Under the circumstances, the casting products stuck between the rocking cutter device and the fixed cutter device or that on either of the cutter devices are relocated (put the casting products somewhere else) by moving the rocking cutter device to the back-most position in order to crush and break the casting products with the apparatus.

Thereafter, the rocking cutter device is moved forwardly. These operations are carried out once or several times to sequentially crush and break the casting products. As a result, easy and reliable operations for crushing and breaking the casting products are automatically carried out without providing too much pressure to the apparatus.

In the present invention, several remarkable advantages described hereunder can be achieved. Because, the crushed-broken casting products are sequentially supplied to the furnace through the discharging conveyer after crushing and breaking the sand-free casting products in the predetermined size as well as preventing an undesirable phenomenon the so called "bridging-phenomenon" caused by improper supply of the casting products so as to form a bridge-shaped pile in the furnace.

The following disadvantages caused by the "bridging-phenomenon" such as interference of combustion gas flow in the furnace, generation of incombustible (harmful) gas due to incomplete combustion caused by not reaching flames to the casting products stuck in a bridge shape, fulfillment of the combustion gas and other gases in the furnace, and degradation of insulating fire bricks of the furnace because of direct flames to the bricks caused by the bridge-shaped pile in the furnace, can be avoided. In the present invention, the casting products can be melted efficiently in the furnace without causing the "bridging-phenomenon" under the "sand-free" condition.

FIG. 8 is another layout of the crushing-breaking apparatus in the present invention. In the apparatus, the useless casting products removed from casting products similar to the example of FIG. 7 are supplied to the apparatus through an overhead travelling crane with a hoist having a magnetic plate. In other words, the useless casting products are safely supplied into the opening with the crane through a space defined between the apparatus and the ceiling of the factory. Similar operations to the apparatus shown in FIG. 7 are also carried out.

Figure 9B:
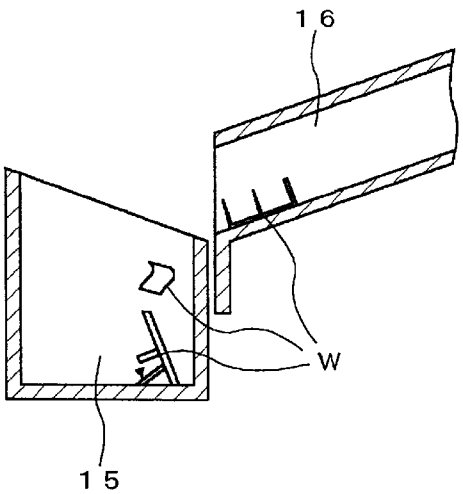
FIG. 9B is a sectional view illustrating a relationship between the supply chute and the elevating bucket.
Figure 9A:
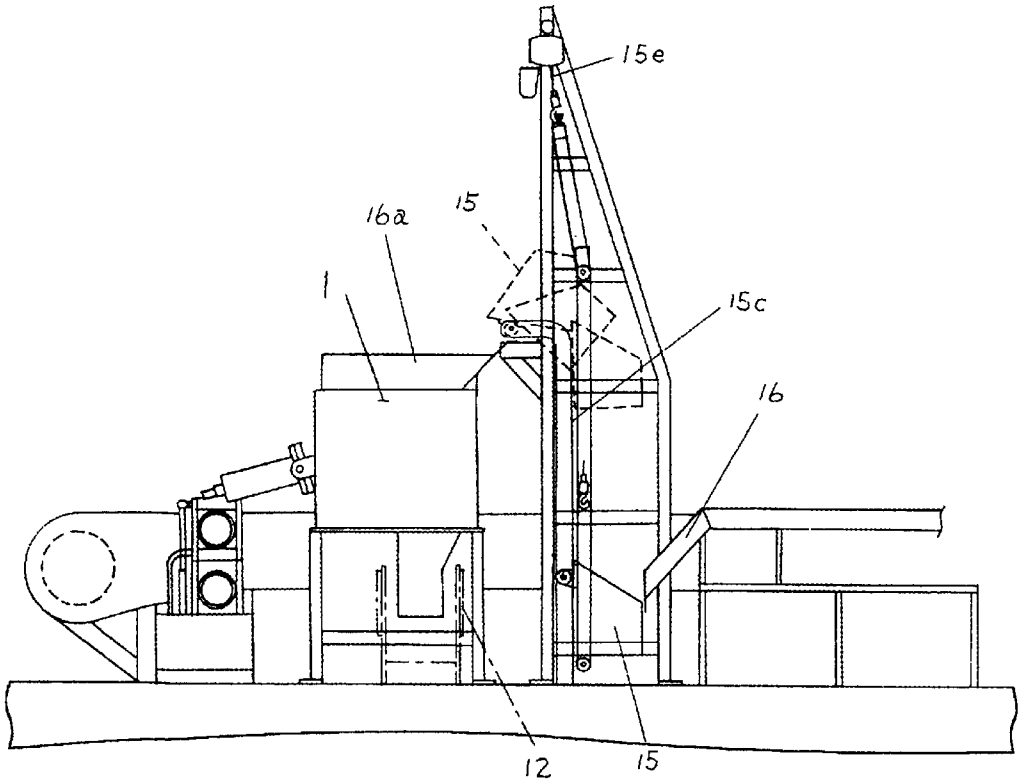
FIG. 9A is another typical side view of the apparatus using a supply chute and another elevating bucket.

FIG. 9A is another layout of the crushing-breaking apparatus in the present invention. In the apparatus, useless casting products removed from casting products similar to the example of FIG. 7 are safely supplied to the apparatus with a feeding device through an upper space defined between the apparatus and the feeding device. The casting products carried with the feeding device are once thrown into an elevating bucket 15 and then supplied into the opening by the movement of the bucket 15. Similar operations to the apparatus shown in FIG. 7 are also carried out.

Figure 10A:
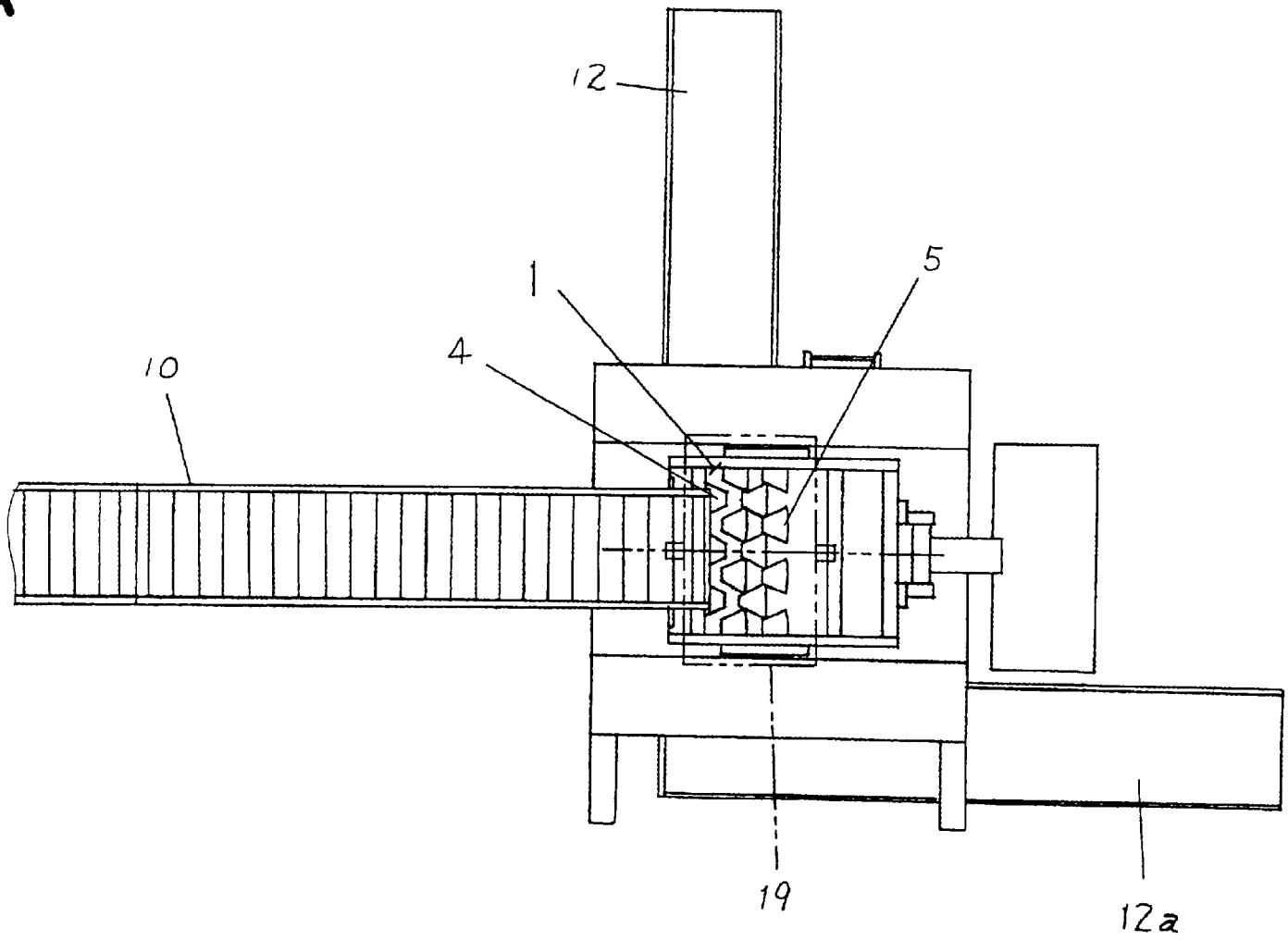
FIG. 10A is a typical plan view of the apparatus using the feeding conveyer and discharging conveyers for discharging crushed-broken casting products in two directions.

FIG. 10A is another layout of the crushing-breaking apparatus in the present invention. In the apparatus, useless casting products removed from casting products similar to the example of FIG. 7 are sequentially supplied to the opening after carrying out removal of undesirable materials stuck with the casting products as well as carrying out removal of tiny pieces of the casting product. The process of removing the undesirable materials can be applied to apparatuses described above and will be described below.

Although, the crushed-broken casting products are discharged through the discharge outlet similar to the apparatus shown in FIG. 7, the casting products are supplied to the furnace with another feeding conveyer (not shown) after conveying the casting products using the directional control device, a feeder conveyer and the discharging conveyer.

Figure 11:
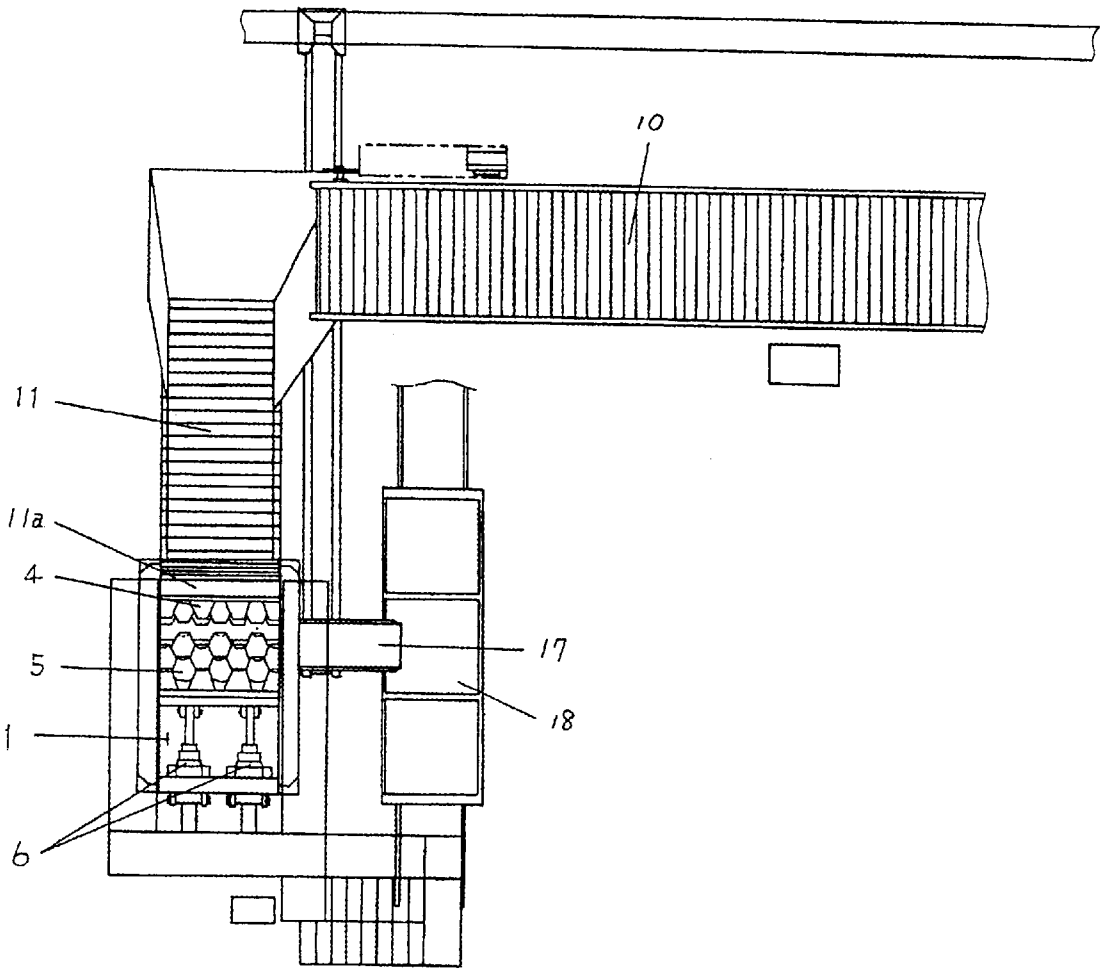
FIG. 11 is a typical plan view of the apparatus using both the feeding conveyer and an apron conveyer.

FIG. 11 is another layout of the crushing-breaking apparatus in the present invention. In the apparatus, useless casting products removed from casting products similar to the example of FIG. 7 are sequentially supplied to the opening after carrying out removal of the undesirable materials and the tiny pieces by using the feeding conveyer and the apron conveyer.

Although the crushed-broken casting products are discharged through the discharge outlet similar to the apparatus shown in FIG. 7, the casting products are supplied to discharging buckets 18 through a discharging chute 17 and are stocked at a certain place. Then the casting products thus stored therein are supplied to the furnace.

THE PREFERRED EMBODIMENTS OF THE PRESENT INVENTION

The layouts of the crushing-breaking apparatus for useless casting products such as sprues, runners and weirs shown in FIGS. 5 through 10 will be described hereunder. An example of the crushing-breaking apparatus employed in the layouts will be described referring to FIGS. 1 through 5. The crushing-breaking apparatus 1 mainly comprises an open-frame 3 including side plates 2*a*, 2*b*, base plates 2*c*, 2*d*, a fixed cutter device 4 and a rocking cutter device 5 both provided in the frame, and a cylinder 6 for rocking the rocking cutter device 5. The fixed cutter device 4 is installed at one end of the frame 3. The fixed cutter device 4 comprises a fixed plate 41 fixed in the frame 3 and a plurality of semi-cone shaped cutters 42 (hereinafter referred to as mating cutters) disposed in a zig-zag fashion on a flat plane 41*a* attachably mounted on the fixed plate 41. The length of the mating cutters 42 disposed on the flat plane 41*a* gradually increases from the upper part of the flat plane 41*a* to the lower part.

Upper surfaces 42*b*' of the mating cutters 42 (the slipping surfaces) are formed such that the runners and the like are crushed and broke into appropriate sizes as recyclable casting materials and slip over the slipping surfaces consistently. In order to engage the fixed cutter device 4 with the rocking cutter device 5, spaces S are formed between adjacent mating cutters 42 disposed on the flat plane 41*a* in a zig-zag fashion. Also, gaps S1 (adjustable) are formed for the recyclable casting products to fall down to the lower part of the apparatus when a plurality of semi-cone shaped cutters (hereinafter referred to as rocking cutters) of the rocking cutter device 5 described later are engaged with the mating cutters. Ribs 43 are mounted on the flat plane 41*a* so as to connect each of the mating cutters 42.

The rocking cutter device 5 comprises a rocking plate 51 rockable within the frame 1 and supported to the frame 1 through a fulcrum 7, the rocking cutters 52 disposed in a zig-zag fashion on a flat plane 51*a* attachable to the rocking plate 51, and a belt shaped cutter 52*c* located on a lower part of the rocking plate 51 so as to extend over the width of the rocking cutter device 5. An upper surface 52*b*' of the rocking cutters 52 and upper surfaces 52*c*' of the belt shaped cutter 52*c* are formed such that the runners crushed and broke in appropriate sizes as recyclable casting materials slip over the slipping surfaces consistently.

The rocking cutter device 5 is pivoted around the fulcrum shaft 7 through contraction of the piston rod 61 of the cylinder 6. The rocking cutter device 5 is pivoted (moved) forwardly and backwardly to the mating cutters 42 of the fixed cutter device 4. A large crushing-breaking force is applied to the rocking plate 51 as a result of efficient conveyance of the pushing force of the cylinder, due to the piston rod 61 being connected to the upper part of the rocking cutter device 5. In other words, the lever and fulcrum principle is utilized in the present invention. Ribs 53 are mounted on the flat plane 51*a* so as to connect each of the rocking cutters 52.

Details of engagement between the fixed cutter device 4 and the rocking cutter device 5 will be described hereunder. The opening S is formed between the flat plane 41*a* of the fixed cutter device 4 and the flat plane 51*a* of the rocking cutter device 5 opposed each other. The opening S is closed and opened after supplying the useless casting products W therein. The useless casting products W are crushed and broken by engaging the rocking cutters 52 of the rocking cutter device 5 with the mating cutters 42 of the fixed cutter device 4.

Figure 1:
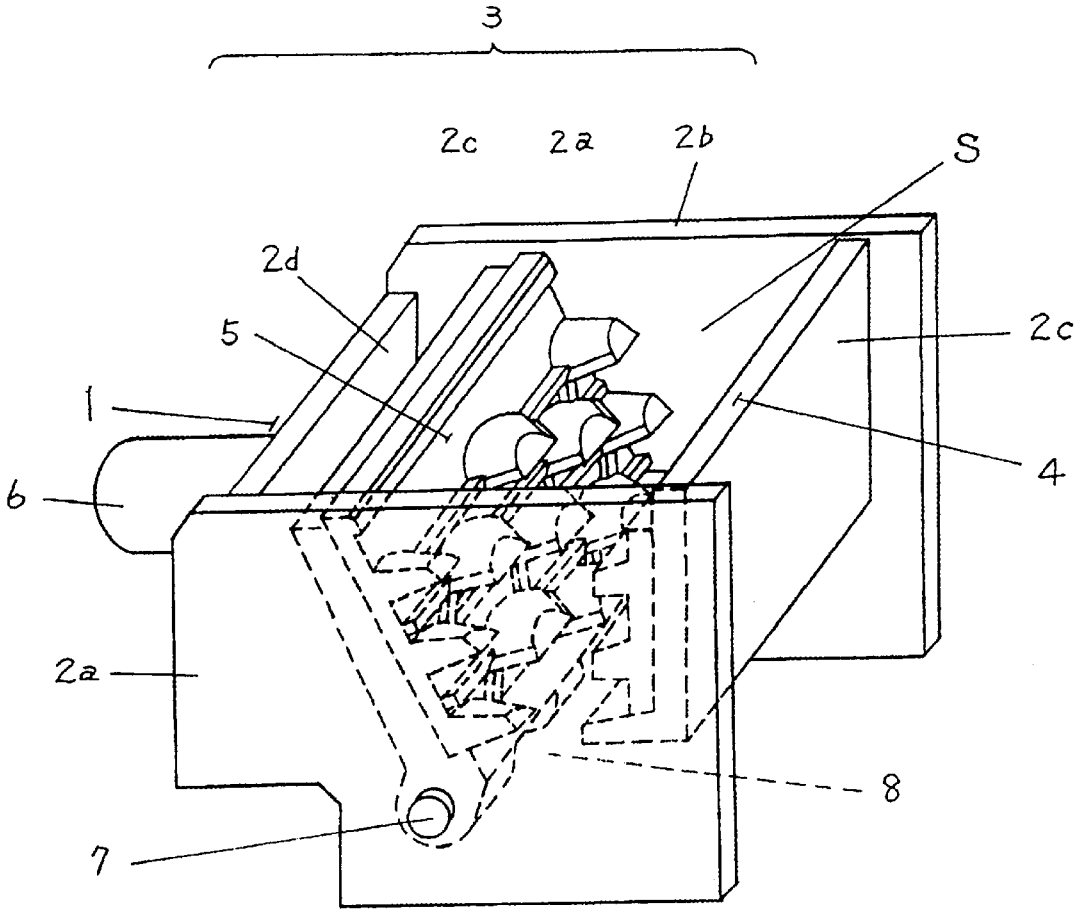
FIG. 1 is a perspective view of a crushing-breaking apparatus used in the present invention.
Figure 2:
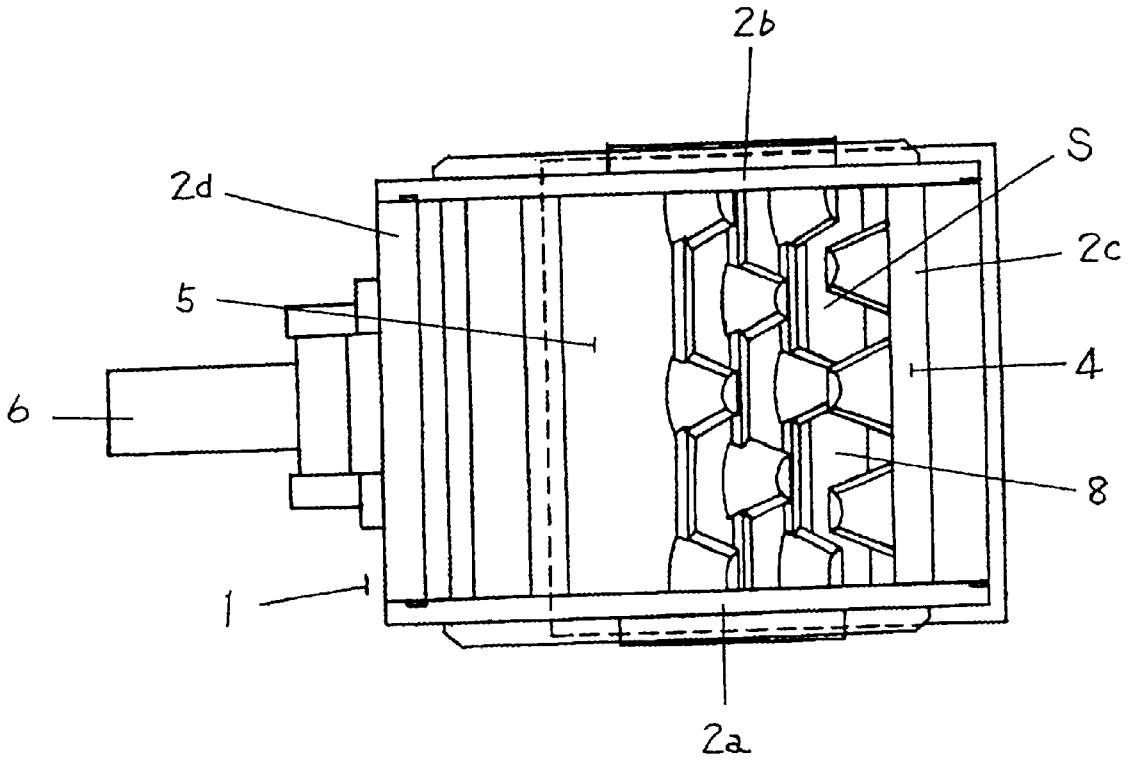
FIG. 2 is a plan view of the crushing-breaking apparatus shown in FIG. 1.
Figure 3:
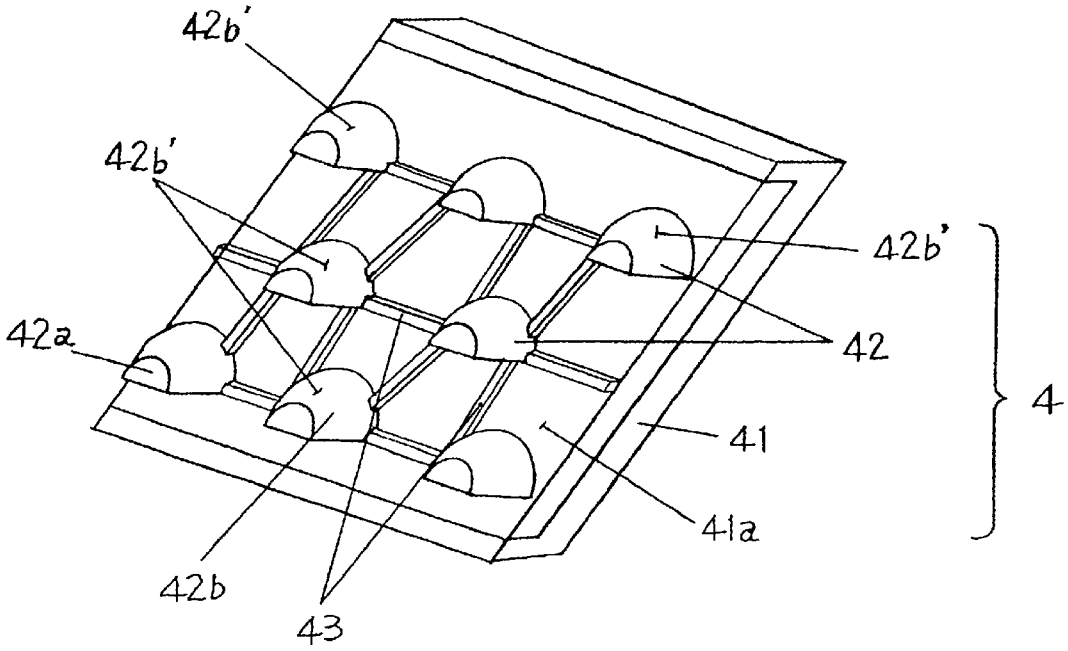
FIG. 3 is an enlarged perspective view of a fixed cutter device of the crushing-breaking apparatus.
Figure 4:
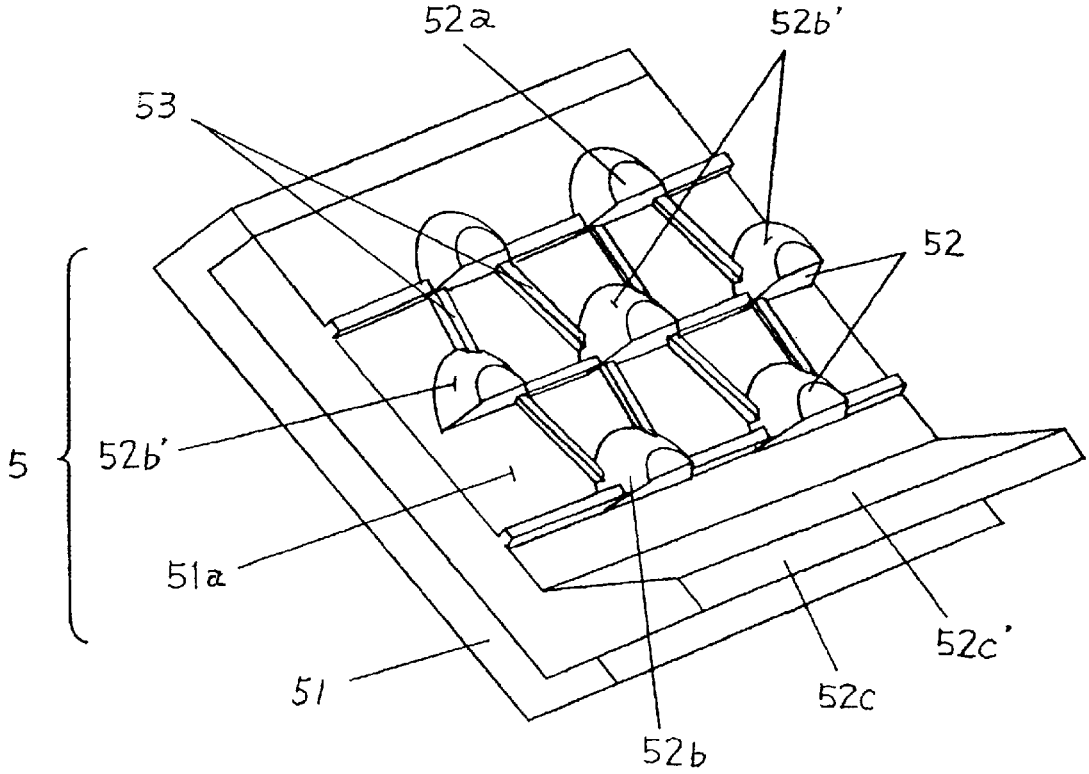
FIG. 4 is an enlarged perspective view of a rocking cutter device used in the crushing-breaking apparatus.
Figure 5:
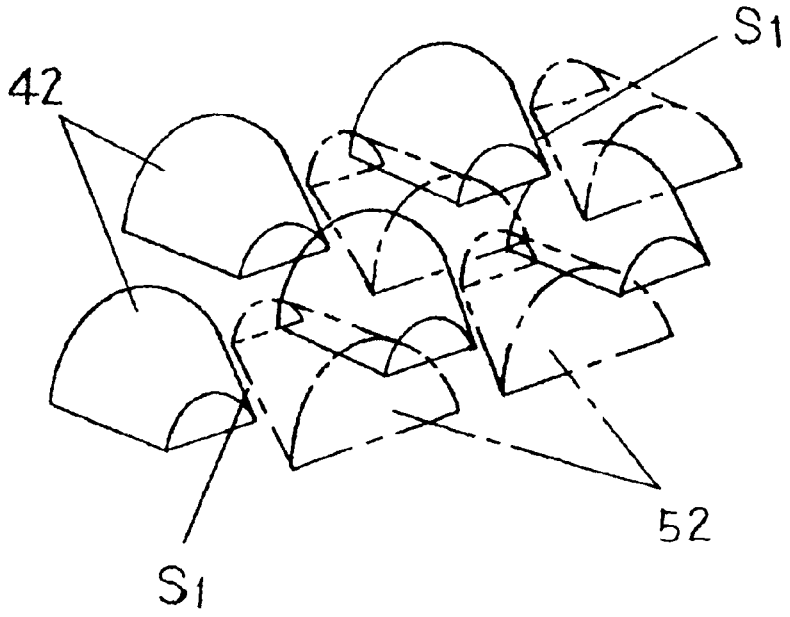
FIG. 5 is a typical view illustrating an engagement between cutters of the fixed cutter device and that of the rocking cutter device.
Figures 6A, 6B:
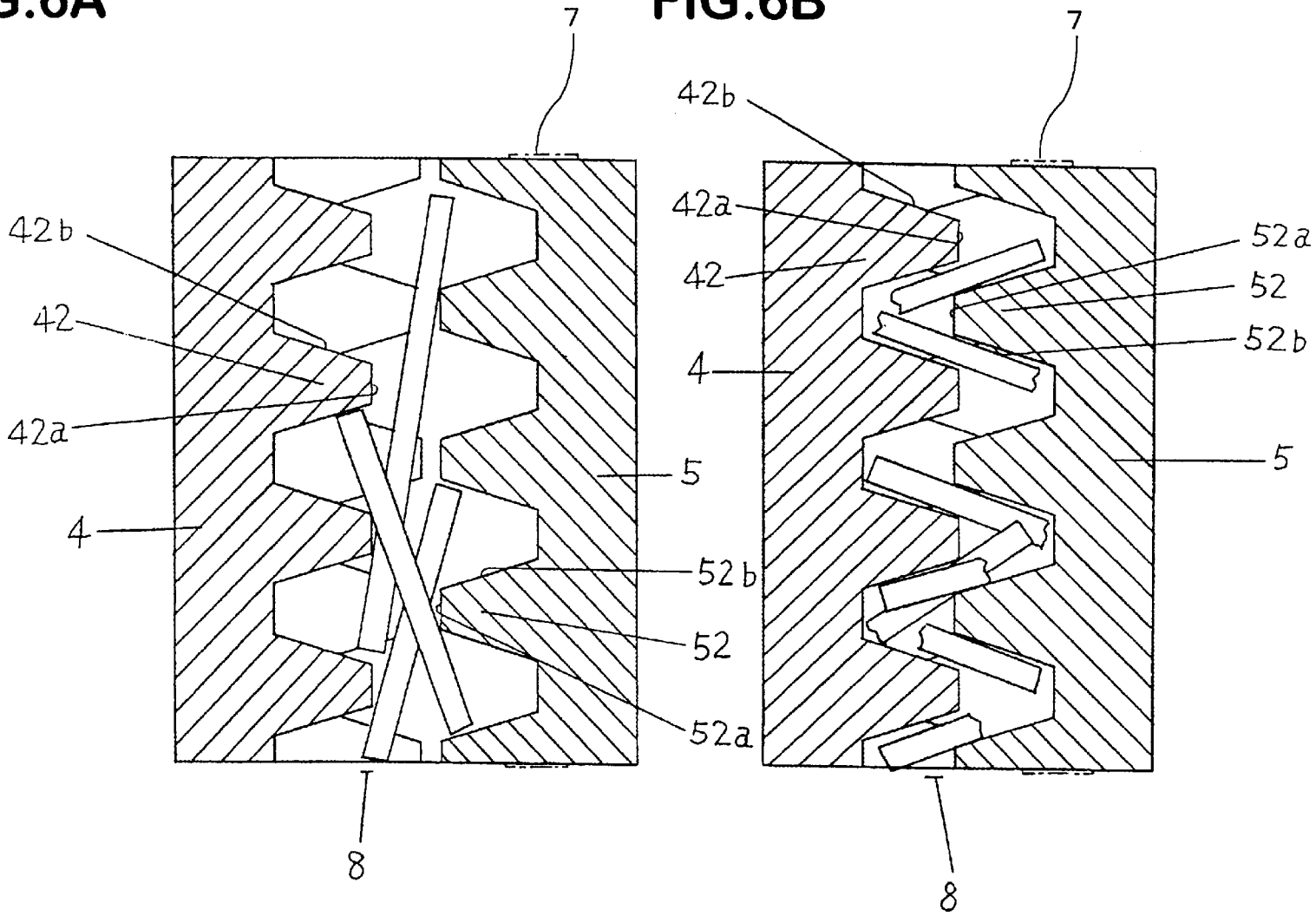
FIG. 6A is an enlarged plan view showing an operating condition of the apparatus such as supplying useless casting products into an opening defined between the fixed cutter device and the rocking cutter device.
FIG. 6B is an enlarged plan view showing another operating condition of the apparatus illustrating closure of the opening in order to crush and break the useless casting products supplied therein.

The casting products thus crushed and broken (crushed-broken recyclable casting materials W1) fall down to the lower part of the apparatus through the gaps S1 between the cutters of both the cutter devices (see FIG. 6B). The gaps S1 are further widen in order to facilitate falling down of the crushed-broken recyclable casting materials W1 to the lower part of the apparatus as well as falling down of the casting materials W1 by the gravity. The casting materials W1 thus fallen down are guided to the discharge outlet 8 and discharged therefrom. Almost all the casting materials W1 (except for undischargeable casting materials W1) are discharged from the apparatus when the rocking cutter device 5 reaches its back-most position. After discharging the casting materials W1, another lot of useless casting products W are supplied into the apparatus.

An example of the layouts for the factory using the crushing-breaking apparatus 1 will be described hereunder. The useless casting products W are supplied to the apparatus 1 with a feeding conveyer 10 forming the feeding device in the layout shown in FIG. 7. In the concrete form of the layout, the useless casting products W are supplied to the apparatus 1 through the apron conveyer 11 also forming the feeding device, a chute 11*a* and the feeding conveyer 10, and the casting materials W1 crushed and broken by the apparatus 1 are discharged therefrom and conveyed with the discharging conveyer (an example of discharging device) 12. In other words, the casting materials W1 are discharged on the discharging conveyer 12 through the discharge outlet 8 when a stopper 44 provided under the discharge outlet 8 is in open state.

Figure 8B:
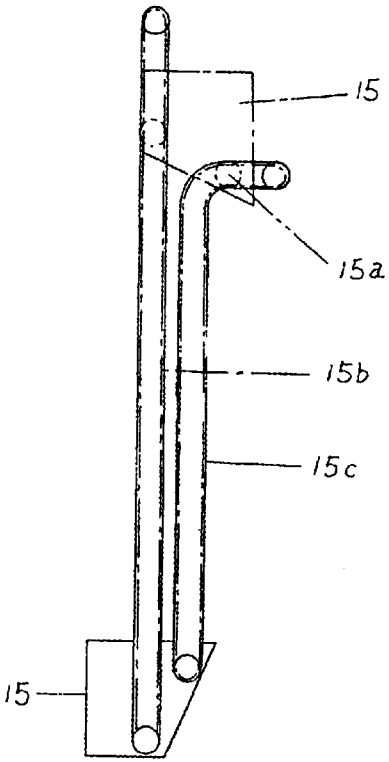
FIG. 8B is view illustrating a device for controlling an elevating bucket.
Figure 8A:
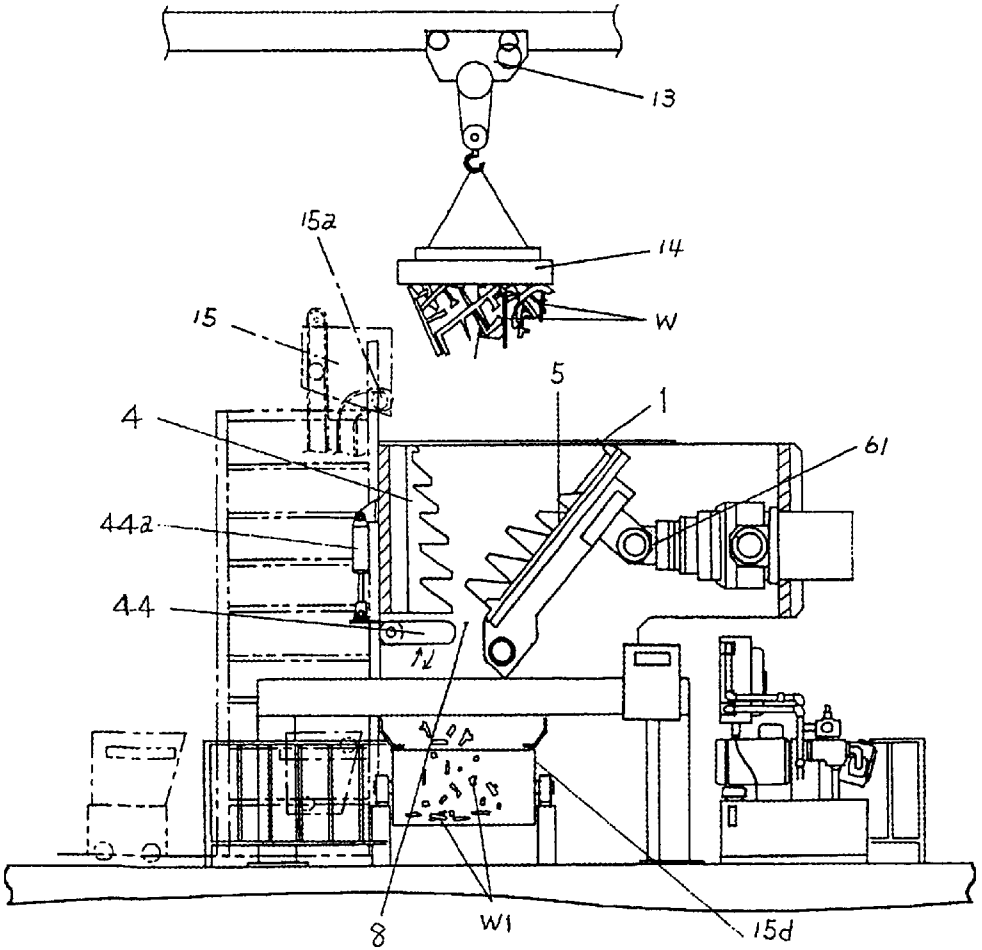
FIG. 8A is another typical side view of the apparatus using an overhead travelling crane with hoist.

In the layout shown in FIG. 8A, the useless casting products W are supplied to the apparatus 1 through an overhead travelling crane 13 with a hoist having a magnetic plate 14 (electromagnetic plate, both the crane and the plate are another example of the feeding device), and the casting materials W1 crushed and broken by the apparatus 1 are discharged on the discharging conveyer 12 similar to the example of FIG. 7. The casting materials W1 thus discharged are conveyed with the discharging conveyer 12.

The useless casting products W can also be supplied to the apparatus 1 with the bucket 15 forming the feeding device operated for supplying the casting products W to the apparatus 1 shown in imaginary (dashed) lines.

In order to control the bucket 15, a device including the bucket 15, guide rollers 15*a* rotatably attached to the bucket, chains 15*b*, guide rails 15*c* shown in FIG. 8B is used. In the FIG. 8B, no drive unit is shown. The bucket 15 is hooked to the chain 15*b* with hooks (not shown). Then, the bucket 15 is pulled up to upped end of the device along with the rails 15*c* in accordance with movement of the chains 15*b*. The guide rollers 15*a* are rotated with the movement of the chains 15*b* to facilitate elevation of the bucket 15. At the upper end of the device, the bucket 15 is turned over (shown in dashed lines) because one of the guide rails 15*a* curves at vicinity of the upper end as shown in FIG. 8B.

Useless casting products W stored in the bucket 15 are thrown into the apparatus 1 as a result of the turning over. The useless casting products W thus thrown into the apparatus 1 are crushed and broken thereby, and casting materials W1 crushed and broken by the apparatus 1 are discharged into a box 15*d* through the discharge outlet 8 when the stopper 44 is in open state (the same shall apply hereinafter). The stopper 44 is swingably moved by a cylinder 44*a*.

In the layout shown in FIG. 9A, the useless casting products W are supplied to the apparatus 1 with the bucket 15 through a supply chute 16 forming the feeding device. As shown in FIG. 9B, the useless casting products W are stored into the bucket 15 through the supply chute 16. The bucket 15 storing the useless casting products W is pulled up and pulled down with a wire rope 15*e*. The bucket 15 can be turned over at the upper end of the guide rails 15*c* similar to that shown in FIGS. 8A and 8B. In this way, the useless casting products W stored in the bucket 15 are thrown into the apparatus 1 as a result of the turning over. The casting materials W1 crushed and broken by the apparatus 1 are discharged on the discharging conveyer 12 and are conveyed thereby.

In the layout shown in FIG. 10A, the useless casting products W are supplied to the apparatus 1 with the feeding conveyer 10. In the concrete form of the layout, the useless casting products W are supplied to the apparatus 1 with the feeding conveyer 10, and the casting materials W1 crushed and broken by the apparatus 1 are discharged through the discharge outlet 8 and conveyed with the discharging conveyers 12, 12*a* by switching of the directional control device 19.

Figure 10B:
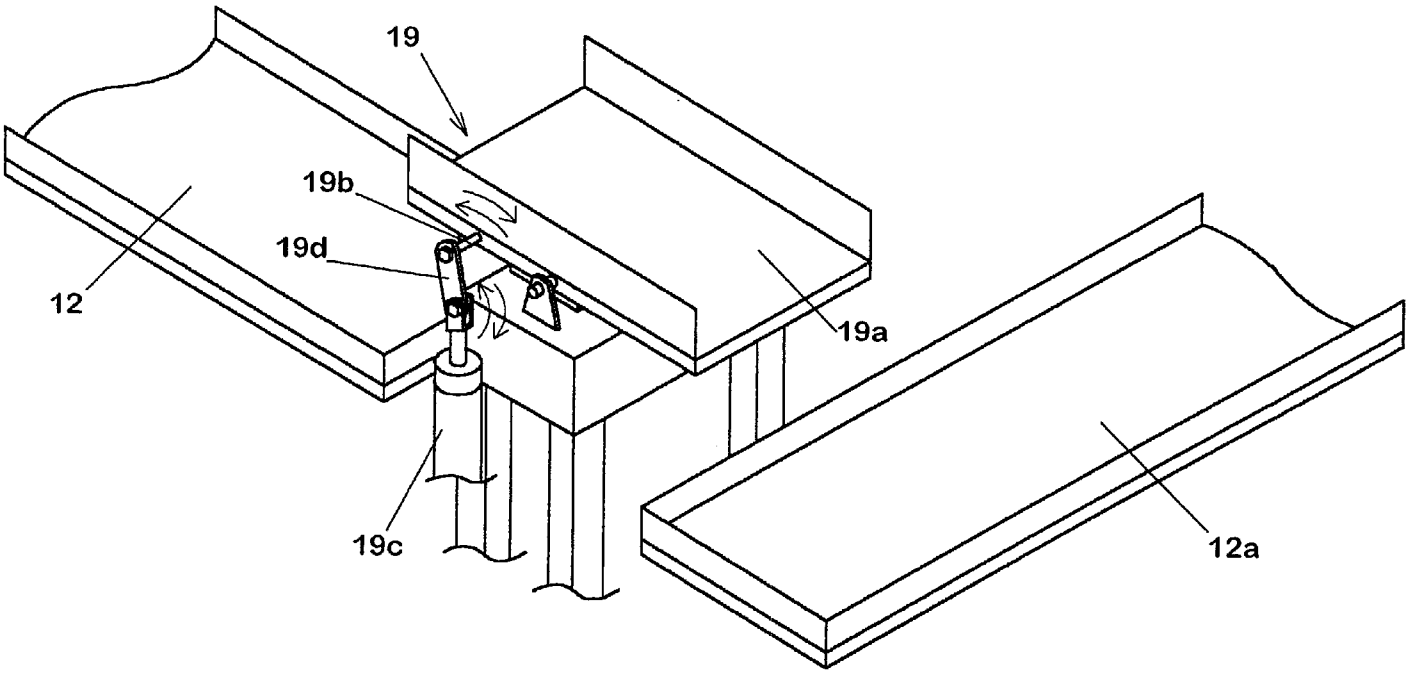
FIG. 10B is a perspective view of a directional control device.

FIG. 10B shows a perspective view of the directional control device 19. The directional control device 19 includes a directional plate 19*a*, a shaft 19*b* connected to the plate 19*a*, a cylinder 19*c* and a link 19*d*. The directional plate 19 is movably fixed right under the discharge outlet 8 through the shaft 19*b* as shown in FIG. 10B. Movement of the directional plate 19 such as a see-saw motion is controlled by the extension and contraction of a cylinder rod of the cylinder 19*c*. In this way, the supply of the casting materials W1 discharged through the discharging outlet 8 are switched to either of the feeder conveyer 12*a* or the discharging conveyer 12.

In the layout shown in FIG. 11, the useless casting products W are supplied to the apparatus 1 with the feeding conveyer 10 and the other conveyer. In the concrete form of the layout, the useless casting products W are supplied to the apparatus 1 with the apron conveyer 11 and the feeding conveyer 10 through the chute 11*a*, and the casting materials W1 crushed and broken by the apparatus 1 are discharged into the discharging buckets 18 forming the discharging device through the discharging chute 17.

Figure 12A:
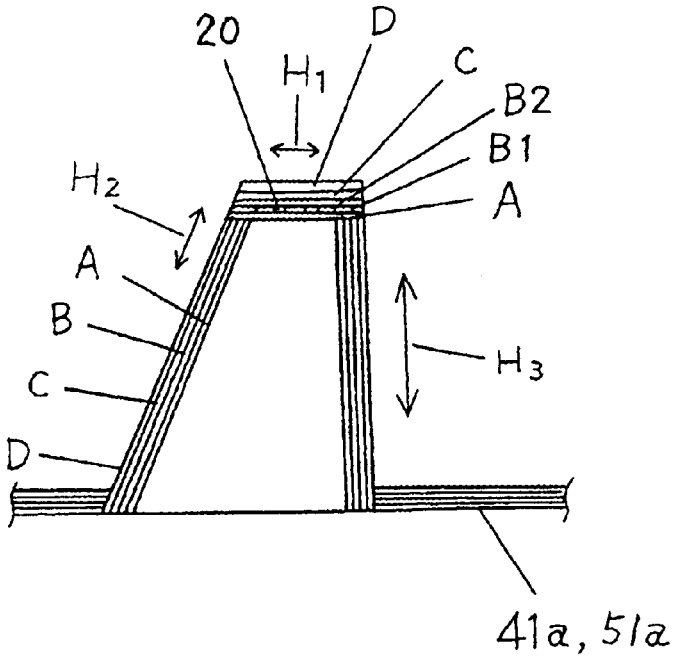
FIG. 12A is a sectional view illustrating top surfaces of mating cutters and rocking cutters coated by the coating method in the present invention.
Figure 12B:
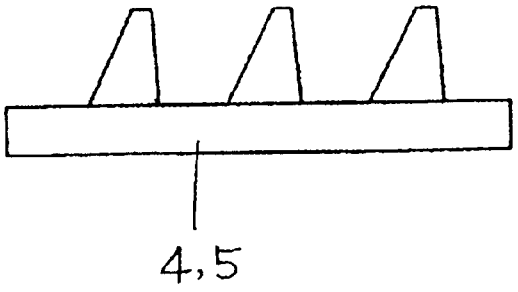
FIG. 12B is a side view of the fixed cutter device or the rocking cutter device the when their surface are coated by the coating method.

FIGS. 12A, 12B through 18 show an example of procedures for overlaying in accordance with a method for coating the fixed cutter device and the rocking cutter device. Each of the figures shows the fixed plate 41 of the fixed cutter device 4, the rocking plate 51 of the rocking cutter device 5, the mating cutters 42 of the fixed plate 41, the rocking cutters 52 of the rocking plate 51, and both the ribs 43, 53 respectively mounted on the flat planes 41*a*, 51*a* of the fixed plate 41 and the rocking plate 51, each of which being overlaid in accordance with the coating method. The flat plane 51*a* is also overlaid by the coating method as required. Overlay layers are formed generally on the flat planes 41*a*, 51*a* of the fixed plate 41 and the rocking plate 51 and both the ribs 43, 55 by the coating method. Preliminary welding is carried out by using a welding material having a low hardness with elongation to form an overlaying layer A. Thereafter, intermediate welding is carried out by utilizing another welding material having a high hardness with a high wear resistance and a high impact resistance to form an overlaying layer B. Upper welding is carried out by using a welding material having a high hardness with a high wear resistance and a high impact resistance to form an overlaying layer C. Overcoat welding is carried out by using a welding material for finishing to form an overlaying layer D as required. Overall thickness of the layers is approximately in 11 mm to 17 mm. On completing formation of the layers, both top surfaces 42*a*, 52*a* of the mating cutters 42 and the rocking cutters 52 are welded in the coating method described above. In other words, preliminary welding is carried out using the welding material having a low hardness with elongation for the overlaying layer A. Then, first intermediate welding is carried out utilizing another welding material having a high hardness with a high wear resistance and a high impact resistance to form an overlaying layer B1 including steel sheets therein. Second intermediate welding is also carried out utilizing another welding material having a high hardness with a high wear resistance and a high impact resistance to form an overlaying layer B2. The upper welding is carried out by using the welding material having a high hardness with a high wear resistance and a high impact resistance to form the overlaying layer C. The overcoat welding is carried out by using the welding material for finishing to form the overlaying layer D as required. Overall thickness of the layers is approximately in 17 mm to 27 mm. The overcoat welding can be carried out simultaneous with circumferential surfaces 42*b*, 52*b* of the mating cutters 42 and the rocking cutters 52 both will be described later. The circumferential surfaces 42*b*, 52*b* are inclined to the flat planes 41*a*, 51*a*. The top surfaces 42*a*, 52*a* of the mating cutters 42 and the rocking cutters 52 are generally coated by carrying out welding in a direction of arrow H1 as shown in FIG. 12A and FIG. 13A.

FIGS. 13A, 13B through 18 show procedures for respectively overlaying the circumferential surfaces 42*b*, 52*b* of the mating cutters 42 and the rocking cutters 52 in accordance with the coating method. The circumferential surfaces 42*b*, 52*b* are welded by treating the surfaces as generally flat surfaces in order to simplify the procedures and to increase accuracy of welding and so on. The circumferential surfaces 42*b*, 52*b* are coated by carrying out welding in a direction of arrow H2 (to the bottom of the mating cutters 42 and the rocking cutters 52).

Figure 13A:
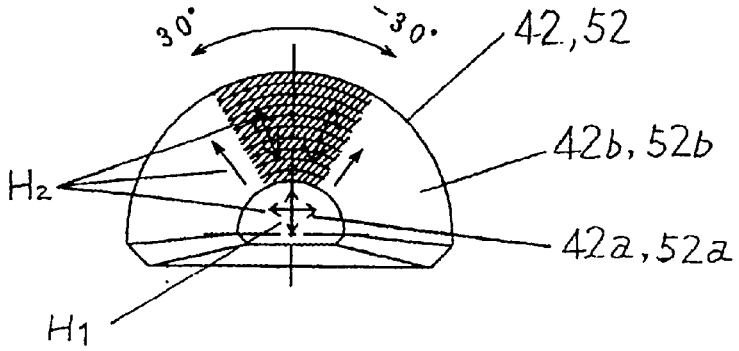
FIG. 13A is a front view of the cutter coated on circumferential surface thereof and procedures for coating the center part thereof using the coating method in the present invention.
Figure 13B:
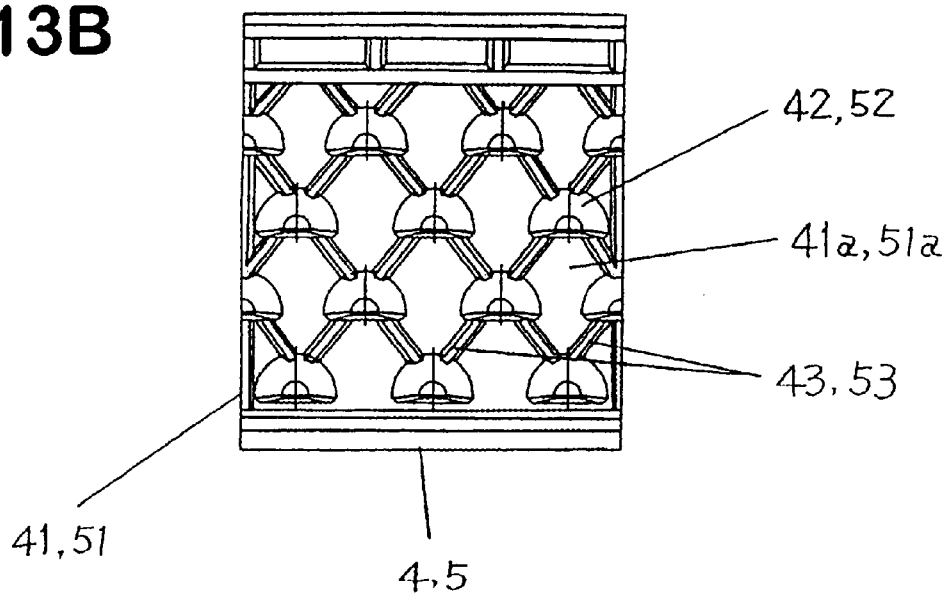
FIG. 13B is a front view of the fixed cutter device or the rocking cutter device illustrating positions to be coated thereof.

The center part of the circumferential surfaces 42*b*, 52*b* are overlaid by keeping both the fixed plate 41 and the rocking plate 51 in vertical to the ground as shown in FIG. 13A and FIG. 13B. The procedures for overlaying the part are as follows. Preliminary welding is carried out using the welding material having a low hardness with elongation to form the overlaying layer A. Thereafter, the intermediate welding is carried out utilizing the welding material having a high hardness with a high wear resistance and a high impact resistance to form the overlaying layer B. Then the upper welding is carried out by using the welding material having a high hardness to form the overlaying layer C.

Figure 14A:
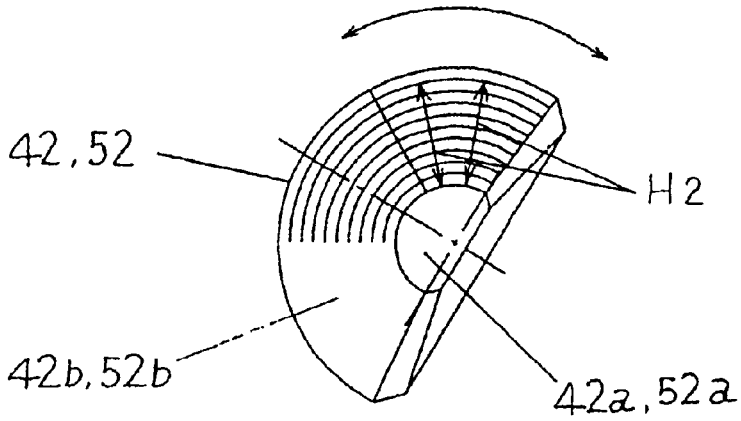
FIG. 14A is a front view of the cutter coated on the left-hand side part of the circumferential surface thereof and procedures for coating the left-hand part using the method of coating cutters in the present invention.
Figure 14B:
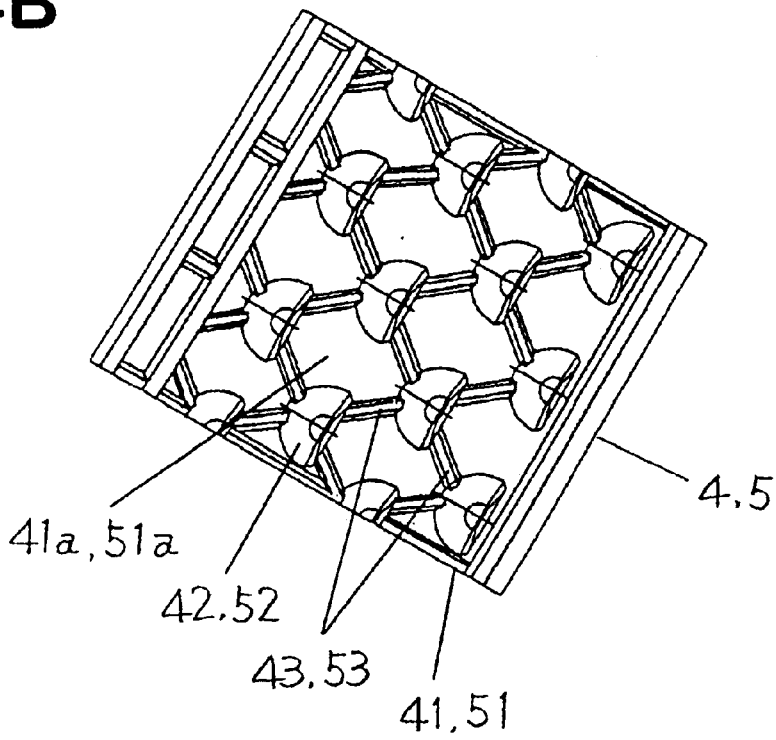
FIG. 14B is a front view of the fixed cutter device or the rocking cutter device illustrating positions to be coated thereof.

The left-hand side of the circumferential surfaces 42*b*, 52*b* are overlaid by keeping both the fixed plate 41 and the rocking plate 51 tilt in the left (facing with the drawings, the same shall apply hereinafter) as shown in FIG. 14A and FIG. 14B. The procedures for overlaying the part are the same as the procedures for forming the overlaying layer A through the overlaying layer C.

Figure 15A:
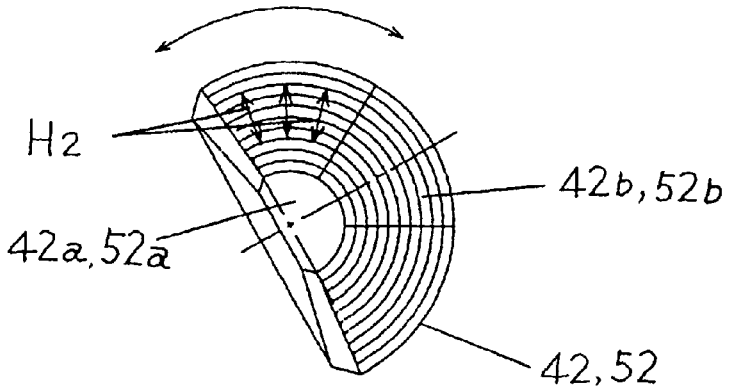
FIG. 15A is a front view of the cutter coated on the right-hand side part of the circumferential surface thereof and procedures for coating the right-hand part using the method of coating cutters in the present invention.
Figure 15B:
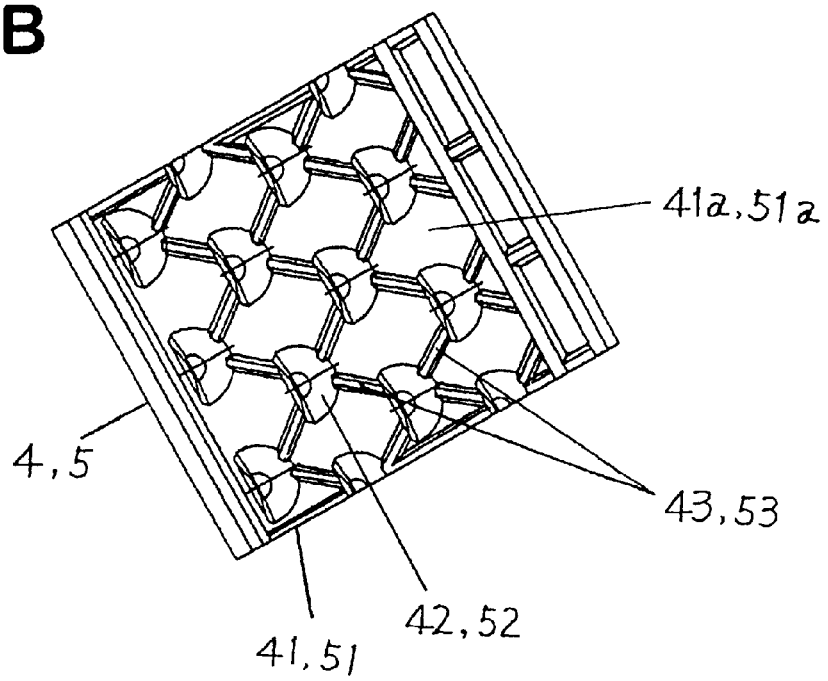
FIG. 15B is a front view of the fixed cutter device or the rocking cutter device illustrating positions to be coated thereof.

The right-hand sides of the circumferential surfaces 42*b*, 52*b* are overlaid by keeping both the fixed plate 41 and the rocking plate 51 tilt in the right as shown in FIG. 15A and FIG. 15B. The procedures for overlaying the part are the same as the procedures for forming the overlaying layer A through the overlaying layer C.

Figure 16A:
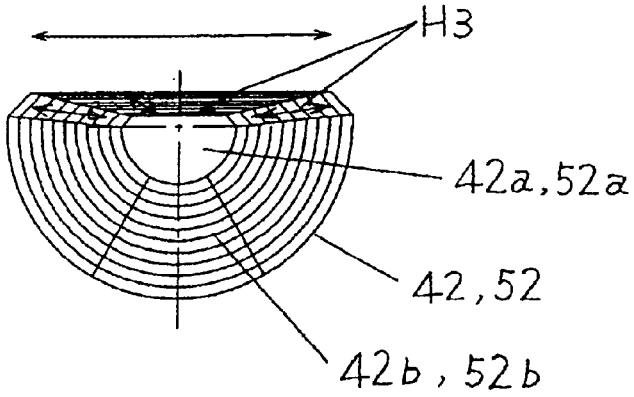
FIG. 16A is a front view of the cutters coated on the lower surfaces of the circumferential surface thereof and procedures for coating the lower surface using the method of coating cutters in the present invention.
Figure 16B:
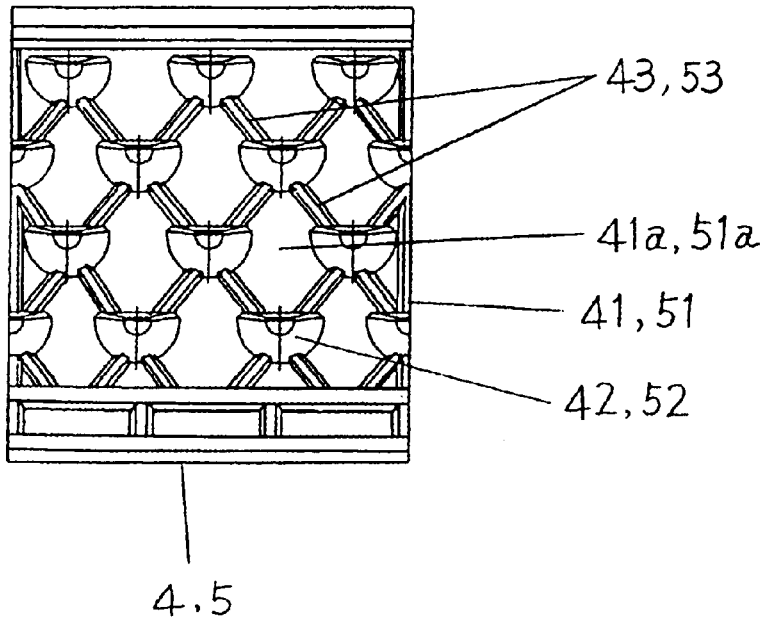
FIG. 16B is a front view of the fixed cutter device or the rocking cutter device illustrating positions to be coated thereof.

Further, the lower surfaces of the circumferential surfaces 42*b*, 52*b* are overlaid by keeping both the fixed plate 41 and the rocking plate 51 in upside down as shown in FIG. 16A and FIG. 16B. The procedures for overlaying the part are the same as the procedures for forming the overlaying layer A through the overlaying layer C. The lower surfaces of the circumferential surfaces 42*b*, 52*b* are coated by carrying out welding in a direction of arrow H3 (to the bottom of the mating cutters 42 and the rocking cutters 52).

Figure 17:
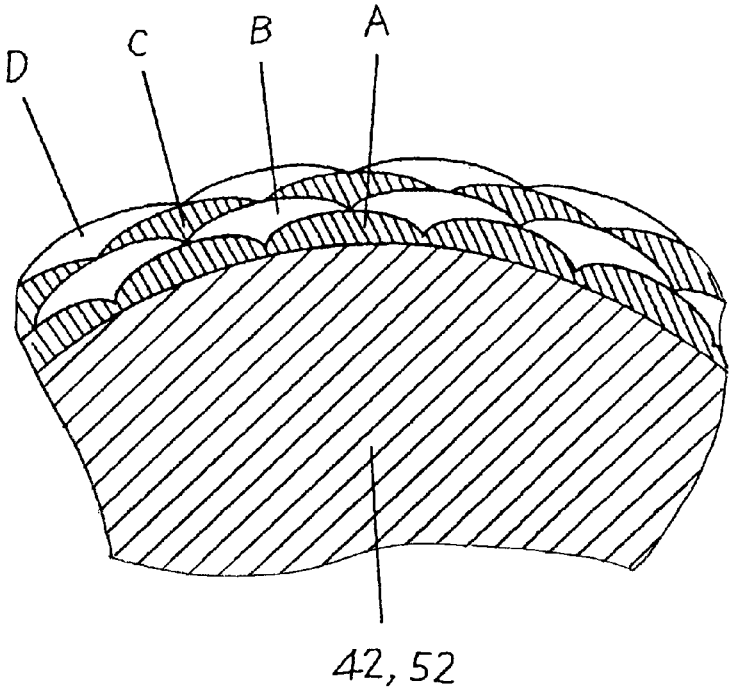
FIG. 17 is an enlarged partial view of FIG. 13A.

FIG. 17 is an enlarged view of FIG. 13A. Overall thickness of the layers is approximately in 11 mm to 17 mm. The overlaying layers A, B1, B2 and C described above can be formed on the circumferential surfaces 42*b*, 52*b* instead of forming the overlaying layer A through the overlaying layer C. It is preferable to carry out arc welding for the overlaying layer A, and $CO_2$ arc welding for the overlaying layers B, B1, and B2 as well as carrying out arc welding for both the overlaying layers C and D. After completing the formation of the overlaying layers A through D, the layers are stricken with hammer and the like to provide "peening effect" in order to harden the layers, and improve strength thereof.

Figure 18:
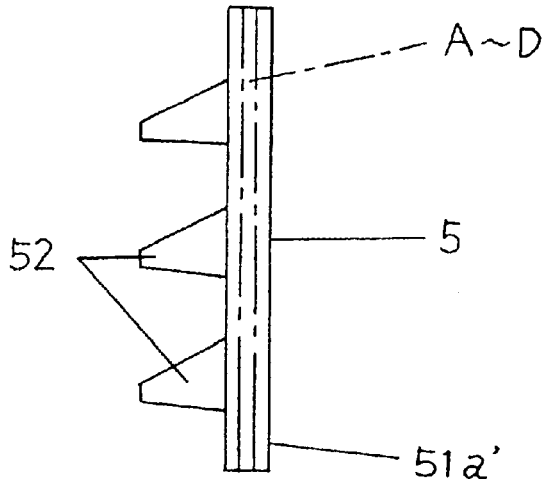
FIG. 18 is a side view of the rocking cutter device having a rocking plate coated by the coating method using overlaying.

FIG. 18 is a side view of the rocking cutter device 5 having a rocking plate 51*a*' being coated with the overlaying layers A through C.

The layout of the present invention is characterized in that, the layout arranges the crushing-breaking apparatus for crushing and breaking the casting products and the useless casting products supplied by the feeding device, the feeding device sequentially supplying the weirs, runners of casting products and the useless casting products to the apparatus, and the discharging device sequentially conveying recyclable casting products crushed and broken by the apparatus adjacent to one another so as to carry out a series of procedures. Therefore, the layout is capable of maintaining a connection among related equipment and the apparatus with efficiency, and achieving a full-automated factory, capable of improving operating efficiency and ensuring the safety can be provided. Further advantages of the layout are of crushing and breaking the useless casting products into appropriate size for the recyclable casting materials as well as capable of obtaining suitable size of materials for a cupola or an electric furnace. Still further advantages of the layout are of achieving effective melting of the crushed-broken casting products and avoidance in generation of incombustible (harmful) gas as a result of preventing the "bridging-phenomenon" under the "sand-free" condition in the furnace.

Also, the layout of the present invention is characterized in that, each of the predetermined positions is a corner of the factory. Therefore, it is possible to achieve the use of the space in the factory with efficiency, the higher efficiency in operation, and the ease of conveyance of the materials.

Further, the coating method of the present invention is characterized in that, the method comprises the steps of coating the flat plane of the fixed cutter device and that of the rocking cutter device, and circumferential surfaces of the mating cutters and that of the rocking cutters with a three-layered overlaying, and coating top surfaces of the mating cutters and that of the rocking cutters with a four-layered overlaying, wherein the circumferential surfaces of the mating cutters and that of the rocking cutters are coated by carrying out welding in a direction of the bottom of the mating cutters the rocking cutters. Therefore, both the mating cutters and the rocking cutters of the fixed cutter device and the rocking cutter device used for the apparatus can be coated efficiently with the overlaying layers. Also, the overlaying layers on the mating cutters and that of the rocking cutters can reliably and easily be formed.

Still further, the coating method of the present invention is characterized in that, the three-layered overlaying are formed by carrying out the following steps, such as preliminary welding using a welding material having a low hardness with elongation, intermediate welding utilizing a welding material having a high hardness with a high wear resistance and a high impact resistance, and upper welding by using a welding material having a high hardness with a high wear resistance and a high impact resistance. Therefore, both the mating cutters and the rocking cutters of the fixed cutter device and the rocking cutter device used for the apparatus can be coated efficiently with the overlaying layers. Also, the overlaying layers on the mating cutters and the rocking cutters can reliably and easily be formed.

The coating method of the present invention is characterized in that, the four-layered overlaying are formed by carrying out the following steps, such as preliminary welding using the welding material having a low hardness with elongation, the first intermediate welding utilizing a steel sheet and a welding material having a high hardness with a high wear resistance and a high impact resistance, second intermediate welding utilizing a welding material having a high hardness with a high wear resistance and a high impact resistance, and the upper welding using the welding material having a high hardness with a high wear resistance and a high impact resistance. Therefore, some of the overlaying layers can be formed rigidly on the mating cutters and the rocking cutters.

Further, the layout of the present invention is characterized in that, the flat plane of the fixed cutter device and that of the rocking cutter device, the mating cutters of the fixed cutter device and the rocking cutters of the rocking cutter device, and circumferential surfaces of the mating cutters and that of the rocking cutters are coated so as to form a three-layered overlaying, and top surfaces of the mating cutters and that of the rocking cutters are coated so as to form a four-layered overlaying. It is therefore possible to improve both the wear resistance and the impact resistance of the mating cutters and the rocking cutters of the fixed cutter device and the rocking cutter device. Further advantage of the layout is of coating the overlaying layers efficiently on the mating cutters and the rocking cutters.

While the invention has been described in its preferred embodiments, it is to be understood that the words which have been used are words of description other than limitation and that changes within the purview of the appended claims may be made without departing from the true scope and spirit of the invention in its broader aspects.

What is claimed is:

1. A system for breaking casting products comprising:

a feeding device sequentially supplying the casting products to a breaking apparatus, the feeding device being arranged at a predetermined position in a factory;

the breaking apparatus constructed and arranged to break the casting products supplied by the feeding device, the breaking apparatus being arranged adjacent to the feeding device and at a predetermined position in the factory; and a discharging device sequentially conveying recyclable casting products broken by the apparatus, the discharging device being arranged adjacent to the breaking apparatus and at a predetermined position in the factory, wherein the breaking apparatus comprises, a fixed cutter device having a plurality of projection shaped mating cutters disposed in offset relation on a substantially flat plane thereof, and a rocking cutter device including a plurality of projection shaped rocking cutters in offset relation on a substantially flat plane thereof, the fixed cutter device and the rocking cutter device being engaged face-to-face with each other, and wherein the substantially flat plane of the fixed cutter device, the substantially flat plane of the rocking cutter device, the mating cutters of the fixed cutter device, the rocking cutters of the rocking cutter device, and circumferential surfaces of the mating cutters and the rocking cutters include a three-layered overlaying, and wherein top surfaces of the mating cutters and the rocking cutters include a four-layered overlaying.

2. The system in accordance with claim 1, wherein each of the predetermined positions is a corner of the factory.

3. An apparatus for breaking casting products, comprising:

a fixed cutter device having a plurality of projection shaped mating cutters in zig-zag fashion on a flat plane thereof, and a rocking cutter device having a plurality of projection shaped rocking cutters in zig-zag fashion on a flat plane thereof, wherein a flat plane of the fixed cutter device, a flat plane of the rocking cutter device, and circumferential surfaces of the mating cutters and the rocking cutters include at least a three-layered overlaying, and top surfaces of the mating cutters and the rocking cutters include at least a four-layered overlaying, wherein the circumferential surfaces of the mating cutters and the rocking cutters include a welding coating running in a direction toward a bottom of the mating cutters and the rocking cutters.

4. The apparatus in accordance with claim 3, wherein the three-layered overlaying coated on the fixed cutter device and the rocking cutter device comprises:

a preliminary welding using a welding material having a low hardness with elongation, an intermediate welding using a welding material having a high hardness with a high wear resistance and a high impact resistance, and an upper welding using a welding material having a high hardness with a high wear resistance and a high impact resistance.

5. The apparatus in accordance with claim 3, wherein the four-layered overlaying coated on the fixed cutter device and the rocking cutter device comprises:

a preliminary welding using a welding material having a low hardness with elongation, a first intermediate welding utilizing a steel sheet and a welding material having a high hardness with a high wear resistance and a high impact resistance, a second intermediate welding utilizing a welding material having a high hardness with a high wear resistance and a high impact resistance, and an upper welding using a welding material having a high hardness with a high wear resistance and a high impact resistance.

* * * * *